US009059549B2

(12) United States Patent
Wu et al.

(10) Patent No.: US 9,059,549 B2
(45) Date of Patent: Jun. 16, 2015

(54) CABLE CONNECTOR ASSEMBLY HAVING AN IMPROVED CABLE WITH AN EQUALIZER FUNCTION

(71) Applicant: HON HAI PRECISION INDUSTRY CO., LTD., New Taipei (TW)

(72) Inventors: Jerry Wu, Irvine, CA (US); Chien-Chiung Wang, New Taipei (TW); Jun Chen, Kunshan (CN); Fan-Bo Meng, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/161,909

(22) Filed: Jan. 23, 2014

(65) Prior Publication Data

US 2014/0213109 A1 Jul. 31, 2014

(30) Foreign Application Priority Data

Jan. 31, 2013 (CN) ..... 2013 1 0038239

(51) Int. Cl.

| | |
|---|---|
| ***H01R 24/00*** | (2011.01) |
| ***H01R 24/62*** | (2011.01) |
| *H01R 27/00* | (2006.01) |

(52) U.S. Cl.
CPC ..... *H01R 24/62* (2013.01); *H01R 27/00* (2013.01)

(58) Field of Classification Search
CPC ..... H01R 23/7073; H01R 13/658
USPC ..... 439/660, 607.48, 607.5
See application file for complete search history.

(56) References Cited

U.S. PATENT DOCUMENTS

| | | | | |
|---|---|---|---|---|
| 6,736,682 | B1 * | 5/2004 | Groebmair et al. | 439/692 |
| 7,892,038 | B1 * | 2/2011 | Kataoka et al. | 439/660 |
| 8,100,725 | B2 | 1/2012 | Su et al. | |
| 8,870,596 | B2 * | 10/2014 | Ii | 439/607.41 |
| 2011/0136391 | A1 * | 6/2011 | Kameyama | 439/660 |

* cited by examiner

*Primary Examiner* — Phuongchi T Nguyen
(74) *Attorney, Agent, or Firm* — Ming Chieh Chang; Wei Te Chung

(57) ABSTRACT

A cable connector assembly includes an insulative housing defining a cavity, a number of contacts retained in the insulative housing, a metallic shell enclosing the insulative housing, and a cable electrically connected with the contacts. The contacts comprise a number of first and second contacts, The cable has at least one pair of differential wires, the pair of differential wires comprising a pair of signal wires and a grounding wire. Each signal wire includes a number of inner wires and an insulator enclosing the inner wires. A metallic conductive layer is disposed between the inner wires and the insulator.

10 Claims, 6 Drawing Sheets

CABLE CONNECTOR ASSEMBLY HAVING AN IMPROVED CABLE WITH AN EQUALIZER FUNCTION

BACKGROUND OF THE INVENTION

1. Field of the Invention

The present invention relates to a cable connector assembly, and more particularly to a cable connector assembly with an improved cable for high speed signal transmission.

2. Description of Related Art

At present, Universal Serial Bus (USB) is a widely used input/output interface adapted for many electronic devices, such as personal computer and related peripherals. In 1994, USB-IF was founded to define a spec of USB. Nowadays, USB-IF has published several editions for USB, and transmission rate of USB has become higher and higher. As development of electronic industry, higher transmitting rate of USB based connection accessory is needed.

U.S. Pat. No. 8,100,725, issued to Su et al. on Jan. 24, 2012, discloses a cable connector assembly in accordance with USB 3.0 standard. The cable connector assembly comprises five first contacts for transmitting high speed signal and four second contacts compatible to the version USB 2.0 standard, and the first contacts are connected with two pairs of differential wires. When signal transmitting rate of the cable connector assembly reaches to 10 Gbps or the transmitting distance becomes farther, a passive equalizer cable or an active cable capable of amplifying signal is needed to connect with the first contacts, thus high cost will be incurred for manufacturing the cable connector assembly.

Hence, an improved cable connector assembly with an equalizer function for increasing transmitting rate and distance is desired to overcome the above problems.

BRIEF SUMMARY OF THE INVENTION

According to one aspect of the present invention, a cable connector assembly comprises an insulative housing defining a cavity, a plurality of contacts retained in the insulative housing, a metallic shell enclosing the insulative housing, and a cable electrically connected with the contacts. The contacts comprises a number of first and second contacts, The cable has at least one pair of differential wires, the pair of differential wires comprises a pair of signal wires and a grounding wire. Each signal wire includes a plurality of normal inner wires and an insulator enclosing on the inner wires, a metallic conductive layer is defined between the inner wires and the insulator.

According to another aspect of the present invention, a cable used for a cable connector assembly, comprises two pairs of differential wires, each pair of differential wires comprises a pair of signal wires for transmitting high-speed signal, a grounding wire and an insulative outer jacket wrapped on the signal wires and the grounding wire, each signal wire includes a plurality of inner wires and an insulator enclosing on the inner wires, a metallic conductive layer is defined between the inner wires and the insulator.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
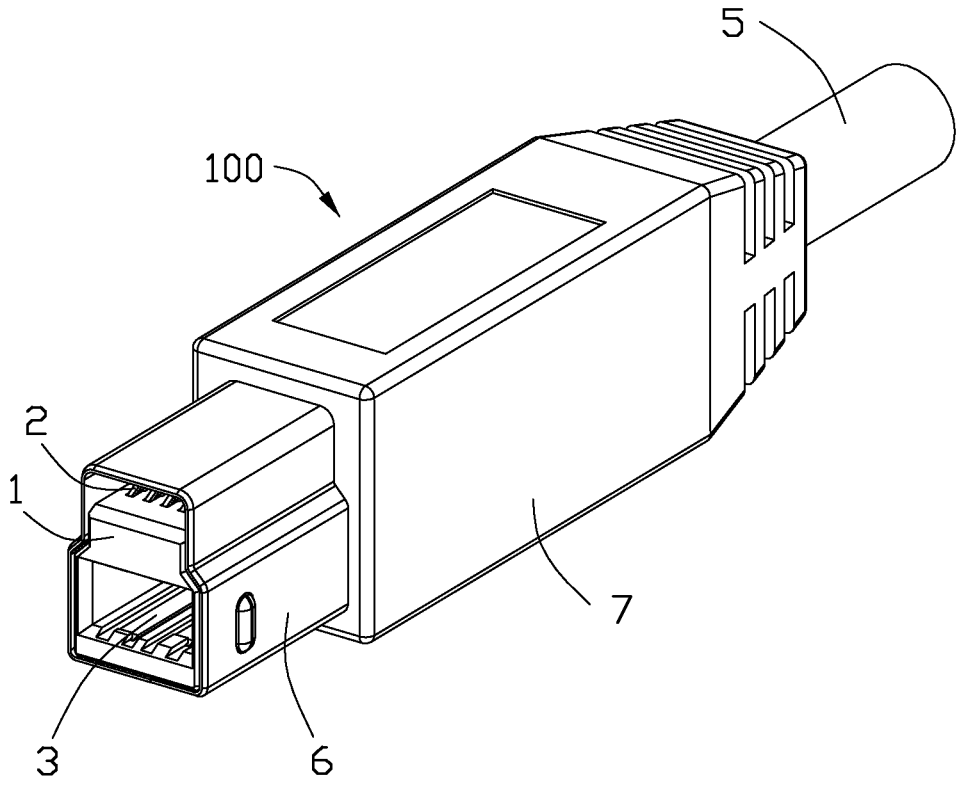
FIG. 1 is an assembled, perspective view of a cable connector assembly according to the present invention.
Figure 2:
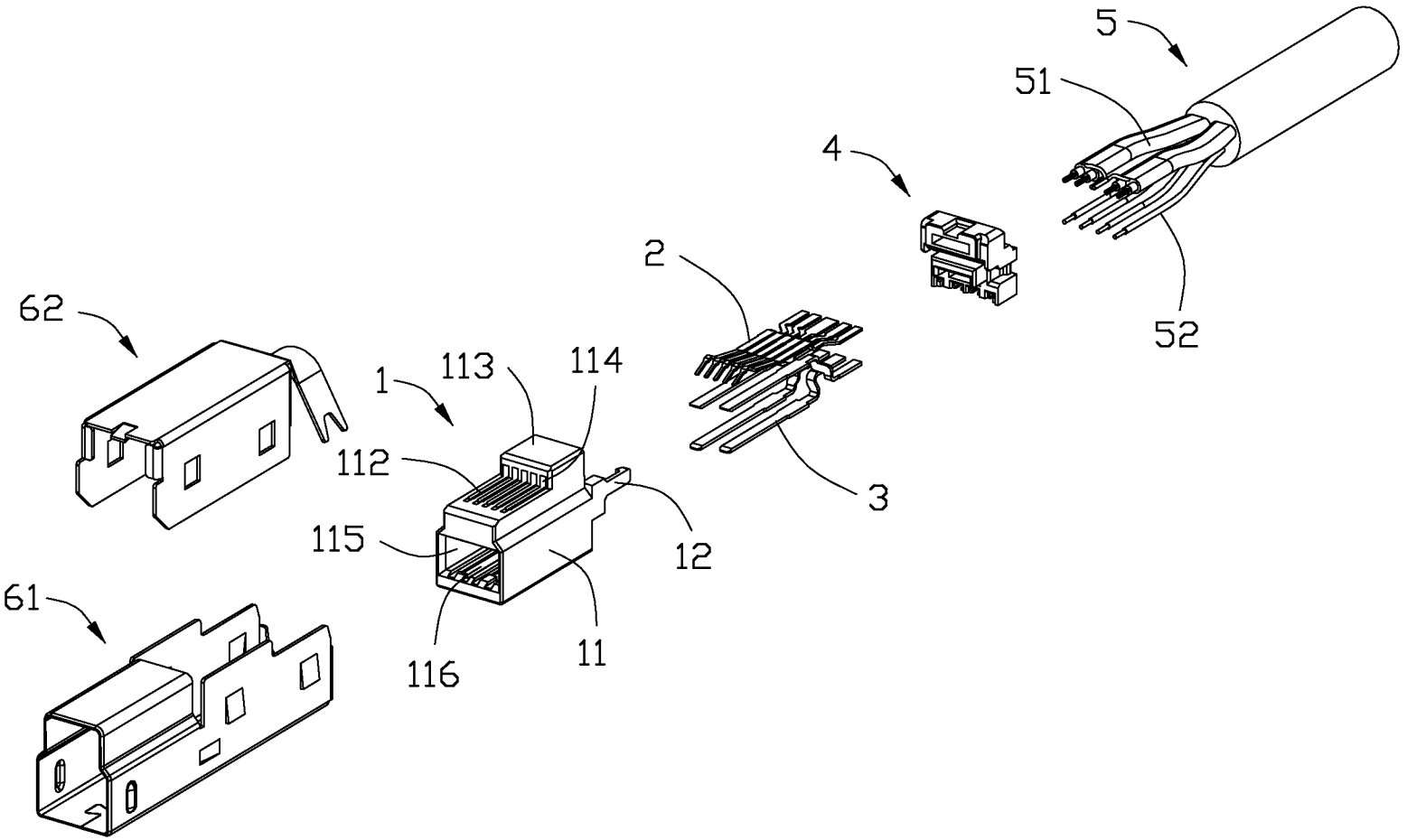
FIG. 2 is an exploded view of the cable connector assembly shown in FIG. 1, with a plastic case removed away.
Figure 3:
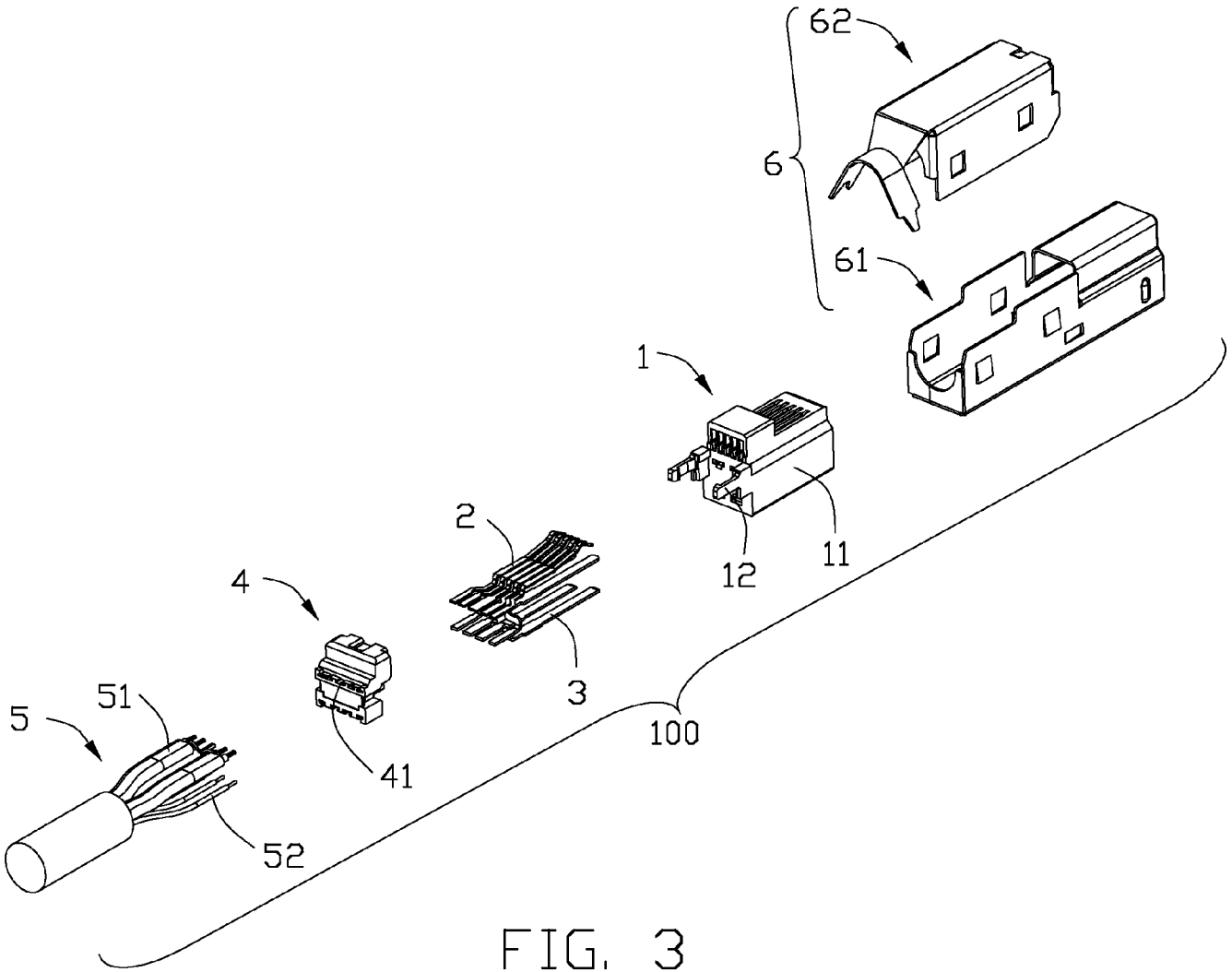
FIG. 3 is similar to FIG. 2, but viewed from another aspect.

Referring to FIGS. 1-3, a cable connector assembly 100 according to the present invention is disclosed. The cable connector assembly 100 is a B-type USB 3.0 plug. The cable connector assembly 100 comprises an insulative housing 1, a plurality of first and second contacts 2, 3 retained in the insulative housing 1, a spacer 4 assembled to the insulative housing 1 for retaining the first and second contacts 2, 3, a cable 5 electrically connected with the first and second contacts 2, 3, a metal shell 6 enclosing the insulative housing 1 for EMI protection, and a plastic case 7 surrounding the metal shell 6.

The insulative housing 1 is molded of dielectric material such as plastic or the like, and comprises a main portion 11 and a pair of latch arms 12 extending backwards from lateral sides of the main portion 11. Five passages 112 are defined on a top surface of the main portion 11, and the main portion 11 has a projecting portion 113 on a back section thereof, the projecting portion 113 is extruding upwards from the top surface of the main portion 11. The projecting portion 113 has five channels 114 communicated with corresponding passages 112. The main portion 11 defines a cavity 115 recessed backwards from a front surface thereof, and a plurality of slots 116 are arranged on an upper wall and a lower wall of the cavity 115.

The first contacts 2 are retained in the passages 112 and include a first pair of differential contacts for transmitting high speed signal, a second pair of differential contacts for receiving high speed signal, and a grounding contact located between the first and second pairs of differential contacts. Each first contact 2 has a tail portion, and five tail portions of the first contacts 2 are arranged on a first level.

The second contacts 3 are retained in the corresponding slots 116 and adapted for B type USB 2.0 protocol, tail portions of the second contacts 3 are located on a second level.

The spacer 4 is assembled to a back end of the insulative housing 1, and has a pair of tabs (not labeled) on both sides thereof to engage with corresponding latch arms 12. A plurality of grooves 41 are defined on a back segment of the spacer 4 for retaining tail portions of the contact.

Figure 4:
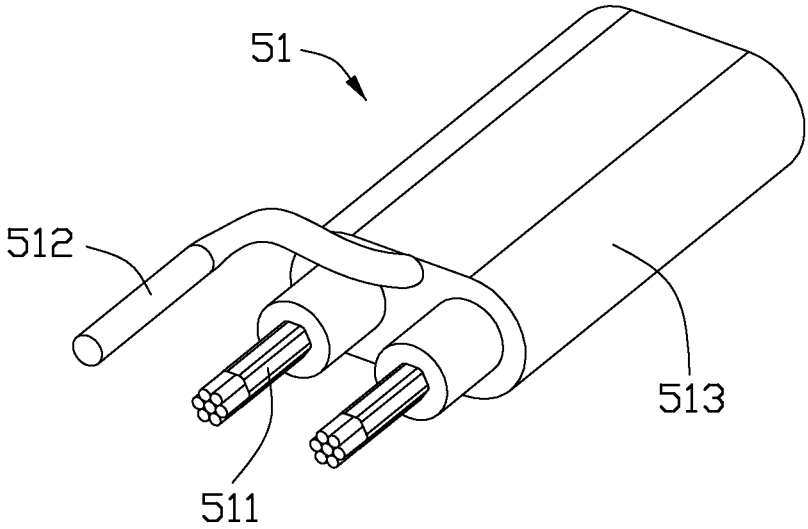
FIG. 4 is an assembled, perspective view of a pair of differential wires of the cable connector assembly shown in FIG. 2.
Figure 5:
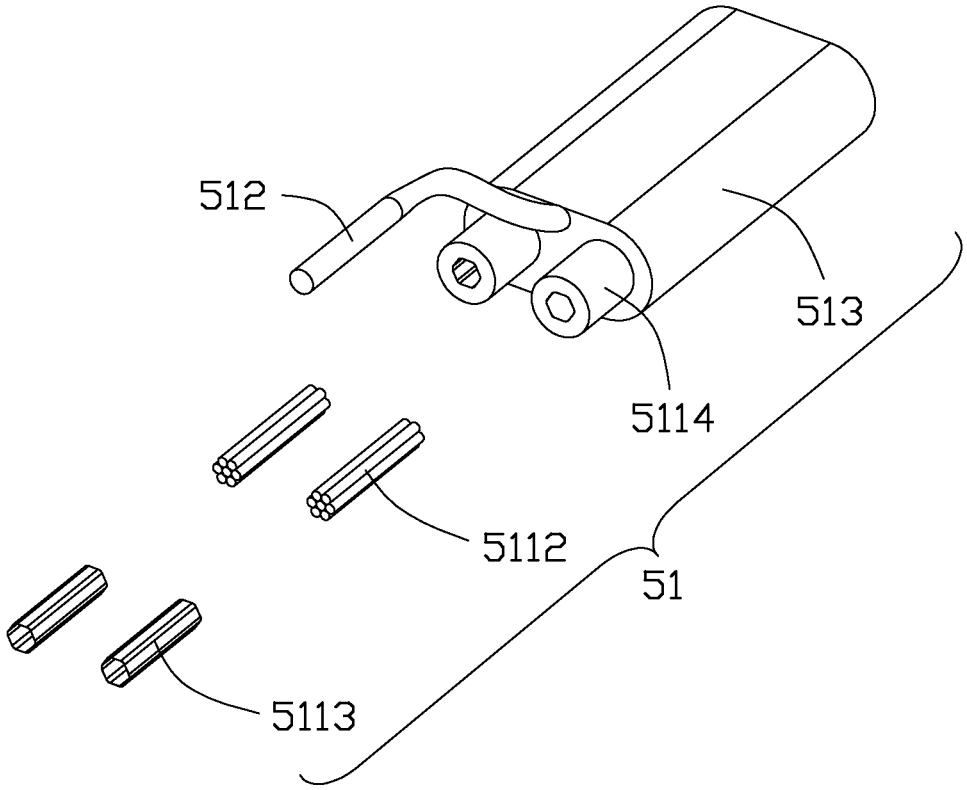
FIG. 5 is an exploded view of the pair of differential wires shown in FIG. 4.
Figure 6:
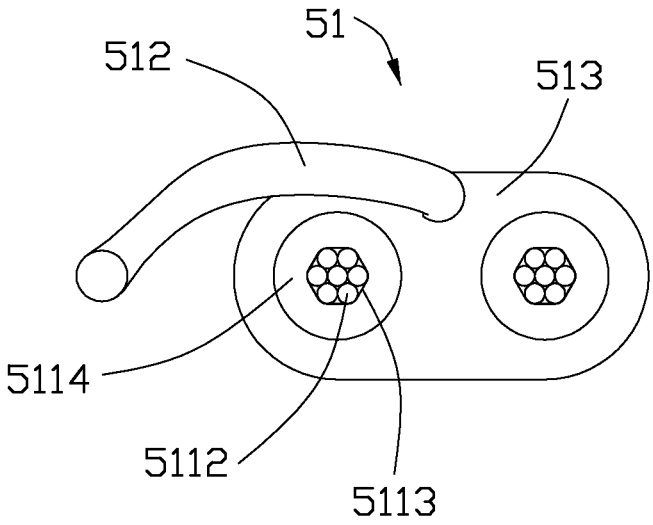
FIG. 6 is a front elevation view of the pair of differential wires shown in FIG. 4.

The cable 5 comprises two pairs of differential wires 51 mechanically and electrically connected with the first contacts 2, and a plurality of individual wires 52 electrically connected with the second contacts 3. Referring to FIGS. 4-6, each pair of differential wires 51 comprises a pair of signal wires 511 for transferring high-speed signals, a grounding wire 512 and an insulative outer jacket 513 wrapped on the signal wires 511 and the grounding wire 512. Each signal wire 511 includes a plurality of normal inner wires 5112 and an insulator 5114 enclosing on the inner wires 5112, a metallic conductive layer 5113 is defined between the inner wires 5112 and the insulator 5114. To ensure bending performance of the cable 5 and enhance the high-frequency performance, due to skin effect, induced currents will be transmitted around the conductive layer 5113 when high-frequency signal transmission, thus can improve high-frequency transmission performance. Thickness of the conductive layer 5113 is designed in accordance with skin depth of the transmission rate, and the conductive layer 5113 is wrapped on the inner wires 5112 in a horizontal direction or a longitudinal direction, the method of wrapping is selectable to meet various performance requirements for high frequency of the cable connector assembly.

A nonconductive layer is kept close to an inner surface of the conductive layer 5113. Signal will be gathered and transmitted on an outer surface of the conductive layer 5113, as a result of isolation of the nonconductive layer in signal transmission, thus the conductive layer 5113 can function as an equalizer. In other selectable embodiment of present invention, a metal layer (not shown), such as nickel, is electroplated on an inner surface of the nonconductive layer.

The metallic shell 6 is made of metallic material, and comprises a first shielding member 61 and a second shielding member 62 assembled each other along an up-to-down direction.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A cable connector assembly comprising:

an insulative housing defining a cavity;

a plurality of contacts retained in the insulative housing, and comprising a number of first and second contacts;

a metallic shell enclosing the insulative housing; and a cable electrically connected with the contacts and having at least one pair of differential wires, the pair of differential wires comprising a pair of signal wires and a grounding wire;

wherein each signal wire includes a plurality of normal inner wires and an insulator enclosing the inner wires, a metallic conductive layer is defined between the inner wires and the insulator;

wherein a nonconductive layer is kept close to an inner surface of the conductive layer;

wherein an insulative outer jacket is wrapped on the signal wires and the grounding wire.

2. The cable connector assembly according to claim 1, wherein the cable comprises a plurality of individual wires electrically connected with the second contacts.

3. The cable connector assembly according to claim 1, wherein the first contacts are used for transmitting high speed signal.

4. The cable connector assembly according to claim 3, wherein the first contacts are mechanically and electrically connected with the pair of differential wires.

5. The cable connector assembly according to claim 4, wherein the second contacts are adapted for B type USB 2.0 protocol.

6. A cable used for a cable connector assembly, comprising:

two pairs of differential wires, and each pair of differential wires comprising a pair of signal wires for transmitting high-speed signal, a grounding wire and an insulative outer jacket wrapped on the signal wires and the grounding wire, each signal wire including a plurality of inner wires and an insulator enclosing the inner wires; wherein a metallic conductive layer is disposed between the inner wires and the insulator;

wherein a nonconductive layer is kept close to an inner surface of the conductive layer;

wherein a metal layer is electroplated on an inner surface of the nonconductive layer.

7. The cable according to claim 6, wherein the cable further comprises a plurality of individual wires.

8. The cable according to claim 7, wherein thickness of the conductive layer is designed in accordance with transmission rate of the cable.

9. A cable connector comprising:

an insulative housing;

a plurality of contacts disposed in the housing and categorized with differential paired contacts and grounding contacts;

a cable located behind the housing and including a plurality of differential wires to be electrically connected to the corresponding differential paired contacts, each of said differential wires including a pair of signal wires and a grounding wires spaced from one another via an insulator, wherein each of said signal wires is composed of plural fine cords commonly intimately surrounded by a metallic layer which functions as an equalizer;

wherein the metallic layer is structurally wrapped upon a common a boundary of said fine cords.

10. The cable connector as claimed in claim 9, wherein a thickness of said metallic layer depends on a transmission rate of said signal wire.

* * * * *